United States Patent [19]

Medeiros

[11] 4,340,075

[45] Jul. 20, 1982

[54] SPACE-SAVING MUSHROOM FORM SUPPORT

[76] Inventor: John M. Medeiros, 244 Depot St., Bennington, Vt. 05201

[21] Appl. No.: 232,508

[22] Filed: Feb. 9, 1981

Related U.S. Application Data

[63] Continuation of Ser. No. 24,471, Mar. 26, 1979.

[51] Int. Cl.[3] ..... A45F 1/16; A01G 13/00

[52] U.S. Cl. ..... 135/15 PQ; 135/5 R; 47/26

[58] Field of Search ..... 135/15 PQ, 15 PE, 1 R, 135/5 R; 47/26, 28; 160/382; 52/73, 301

[56] References Cited

U.S. PATENT DOCUMENTS

| | | | |
|---|---|---|---|
| 224,200 | 2/1880 | Mayer | 135/15 PQ |
| 1,610,801 | 12/1926 | McKinnon | 135/15 PQ |
| 1,669,611 | 5/1928 | Goldberg | 135/15 PQ |
| 2,988,096 | 6/1961 | Otto | 135/15 PQ |
| 3,106,218 | 10/1963 | Wright | 135/15 PQ |
| 3,241,202 | 3/1966 | Knaugt | 135/15 PE |
| 3,289,363 | 12/1966 | Patch | 52/73 |
| 3,525,185 | 8/1970 | Bloxom | 52/73 |

FOREIGN PATENT DOCUMENTS

| | | | |
|---|---|---|---|
| 2500285 | 7/1976 | Fed. Rep. of Germany | 135/15 PQ |
| 77301 | 9/1918 | Switzerland | 52/301 |
| 4630 | of 1903 | United Kingdom | 135/15 PQ |

*Primary Examiner*—J. Karl Bell

[57] ABSTRACT

The invention is an improvement in the mushroom-form support which provides the advantages of ready detachability, ready disassembly, and compactness for packaging, shelving, shipping and storing.

3 Claims, 6 Drawing Figures

SPACE-SAVING MUSHROOM FORM SUPPORT

This is a continuation of application Ser. No. 24,471, filed Mar. 26, 1979.

CROSS REFERENCE

This application is related to the inventor's previous application of Nov. 11, 1977, entitled: Mushroom Form Support, Ser. No. 850,839, now abandoned.

The prior art of supporting flexible film or fabric for the protection of plants includes the mushroom-form support. The broad, smooth and rounded surface of the mushroom form is useful for making a shelter for plants by holding the film in a supported position above the plants. The utility of the mushroom-form support is further disclosed in U.S. Pat. No. 2,988,096, Otto, June 13, 1961, and in U.S. Pat. No. 3,106,218, Wright, Oct. 8, 1963.

The object of the present invention is to provide an improved film support which has the useful advantages of being readily attachable to and detachable from a suitable pole, and which can be readily diassembled and when disassembled requires significantly less volume of space when packaged in sets for sale or shelving or shipping or when stored for future use than is required by sets of assembled or one-piece mushroom-form supports. The present invention is a combination of two parts, the first part being a convex mushroom-cap-shaped head, provided with a recess in the top center, and a flat, circular surface on the bottom center, and an opening through the center for receiving a threaded bolt, and the second part being a slightly tapered tumbler-shaped hollow stem, provided with an opening through the center of the flat, circular end for receiving a threaded bolt, which two parts functioning together provide the useful advantages previously cited.

The objects and advantages of the invention are disclosed in greater detail in the following drawing and description.

Figure 1:
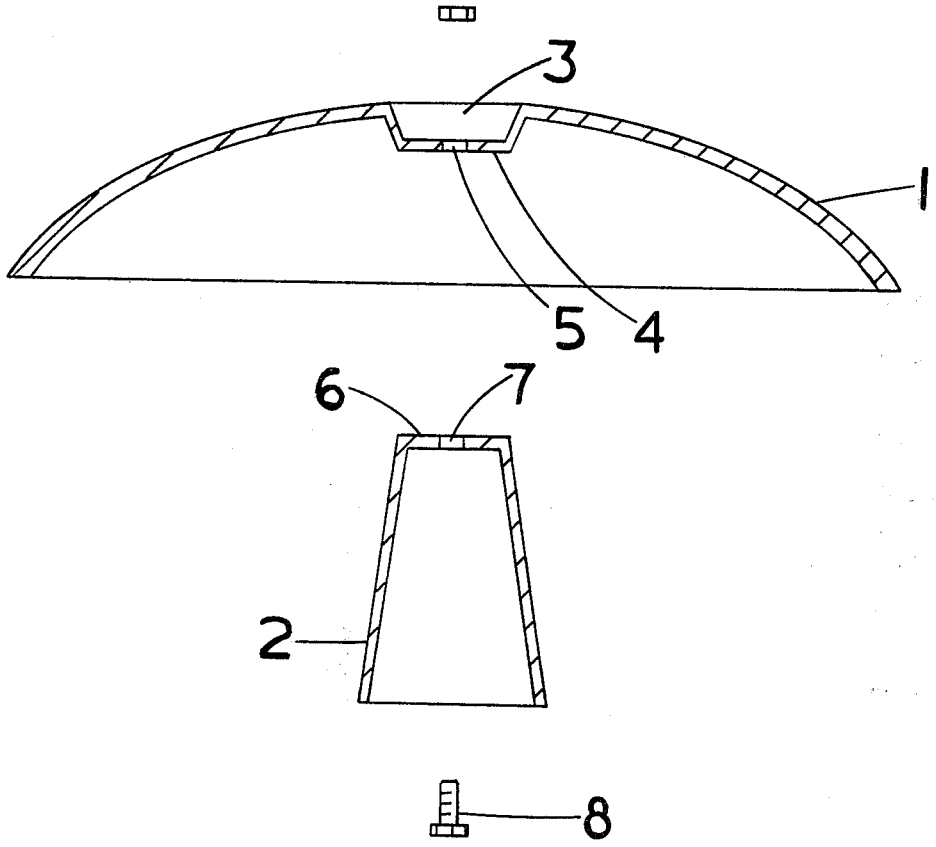
FIG. 1 is a vertical section view of the invention disassembled.
Figure 2:
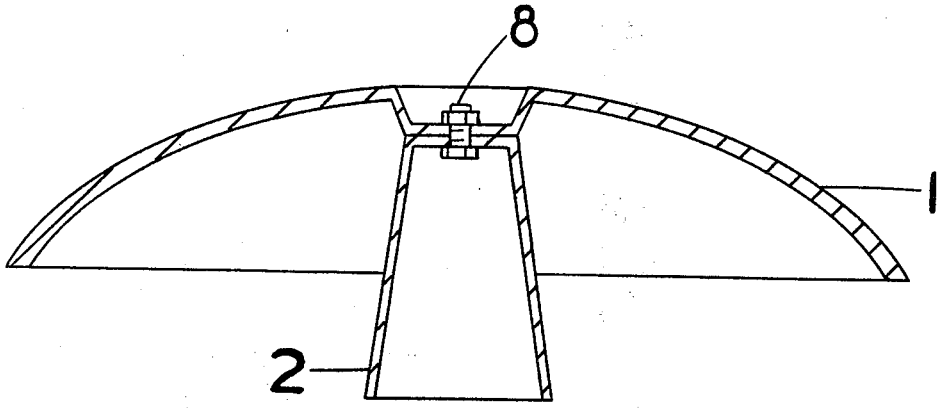
FIG. 2 is a vertical section view of the invention assembled.

The invention is embodied in the structures of the head 1 and the stem 2, which two parts are illustrated disassembled in FIG. 1. The head is provided with a recess in the top center 3, and with a flat, circular surface on the bottom center 4, and with an opening through the center 5 for receiving a threaded bolt 8. The stem is hollow and tumbler-shaped, having a slightly tapered form and having a flat, circular end 6 provided with an opening through the center 7 for receiving a threaded bolt 8. When the two parts are assembled by compression of the threaded bolt 8, as illustrated in FIG. 2, the head 1 and the stem 2 are securley connected and provide a mushroom-form film support with the advantages of the smooth and convex upper surface of the head, which is useful for supporting flexible film, and the slightly-tapered hollow stem, which is useful for readily fitting onto a suitable pole and being readily detached from said pole.

Figure 3:
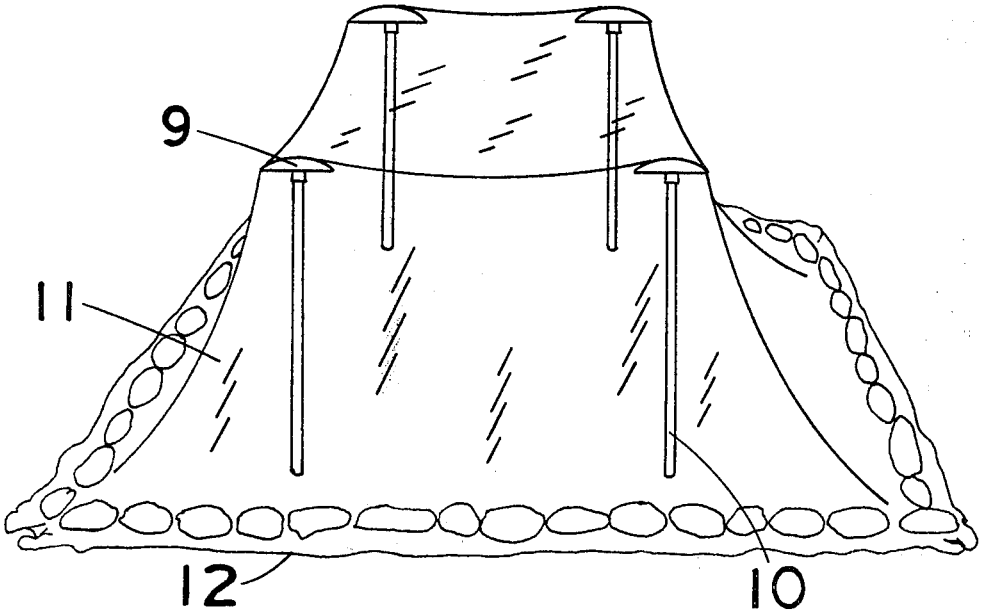
FIG. 3 is a perspective view of the invention in use.

An example of the assembled invention being used as conceived by the inventor is illustrated in FIG. 3, showing the assembled invention 9 fitted onto a suitable supporting pole 10 with the film 11 being held in a supported position by the invention, and the edges of the film 12 held in position by stones. When the invention is not in use for supporting film and instead is packaged for shipping or sale, or in storage, its two parts can be readily disassembled and stacked separately, in which case the invention occupies substantially less space then would be required by a one-piece mushroom-form support of the same size and scale. It will be obvious that a mushroom-form support is most useful when used in sets of four, or twelve, or hundreds of units. The invention is not restricted to or embodied in any specified set of dimensions or specified size or scale; however, the space-saving advantage of the invention is best illustrated and described when a comparison is made between sets of one-piece mushroom-form supports and sets of the invention where both structures are of the same size and scale. For purposes of this comparison, the mushroom-form supports illustrated in FIG. 4 are drawn approximately to a scale wherein the dimensions applicable for the comparative calculations of space are: head height—$2\frac{1}{2}$; head diameter—12; stem height—$3\frac{1}{2}$; stem smaller diameter—$1\frac{1}{2}$; stem larger diameter—$2\frac{1}{2}$; stem extension below head—$1\frac{3}{4}$; additional height required for each additional head when stacked—$\frac{3}{4}$; additional height required for each additional stem when stacked—$1\frac{1}{4}$.

Figure 4:
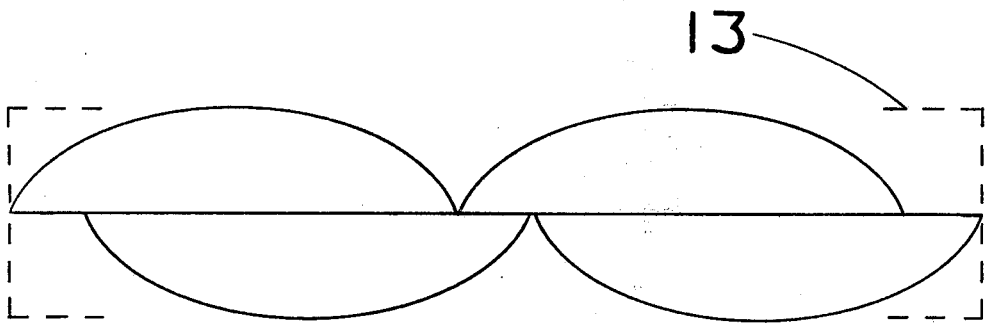
FIG. 4 is an elevation view showing a set of one-piece mushroom-form supports and a set of the disassembled and stacked invention.
Figure 4:
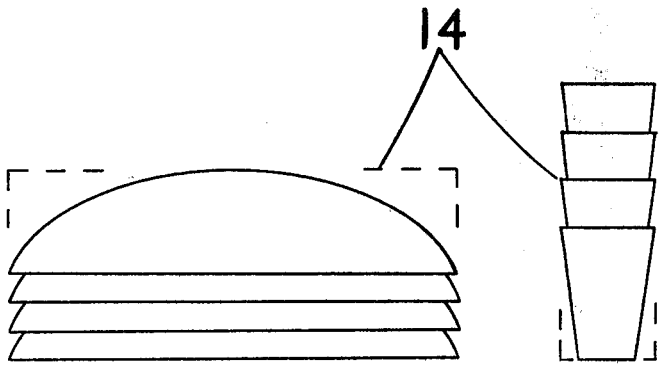

A set of four one-piece mushroom-form supports, arranged in a manner requiring the least volume of space is shown at 13 in FIG. 4, requiring 1,560 units of volume of space when packaged, shipped or stored.

A set of four improved film supports disassembled and stacked is shown at 14 in FIG. 4, requiring 684 units of volume of space for the stacked heads, and 45.3 units of volume of space for the stacked stems, when packaged, shipped or stored, with the required bolts, not shown in the drawing, occuppying available space within the hollow stems.

The space-saving advantage of the improved film support is cumulative as the number of supports packaged, shipped or stored increases. A set of twelve one-piece mushroom-form supports, arranged in a manner requiring the least volume of space, would require 4,440 units of space. A set of twelve improved film supports, disassembled and stacked, would require 1,548 units of space for the stacked heads, and 107.7 units of space for the stacked stems, a total of 1,655.7 units as compared to the 4,440 units required for the twelve one-piece supports. One hundred one-piece supports would require 36,120 units of space, while one-hundred improved film supports would require 11,846 units of space. The additional space required for each additional pair of the one-piece supports would be 720 units, while the additional space required for each additional pair of improved film supports would be 231.6 units.

When the invention is assembled for use, the recess provided in the convex head protects the film from contact with the angular and abrasive surfaces of the threaded bolt. The flat, circular surface on the bottom center of the head serves to provide a broad, plane surface for direct contact with the flat, circular end of the hollow stem and for stable attachment of the two parts by the compression of the threaded bolt. The hollow stem, having a slightly tapered form, can be readily fitted onto a pole or readily taken off. When the invention is disassembled, by simply removing the threaded bolt, for packaging, shelving, shipping or storage, the convex heads can be stacked so that much of the volume of one fits into and occupies the same space as the next above. The same is true of the hollow stems. The invention will be most useful to home gardeners and commercial growers who need to erect temporary shelters for plants and who need to store the film supports when not in use. The stackability and space-saving advantage of the two parts of the improved film support will reduce the inconvenience and cost of packaging, shipping, shelving when offered for sale, and storing when not in use. The invention will be suitably manufactured by either compression molding or injection molding.

Figure 5:
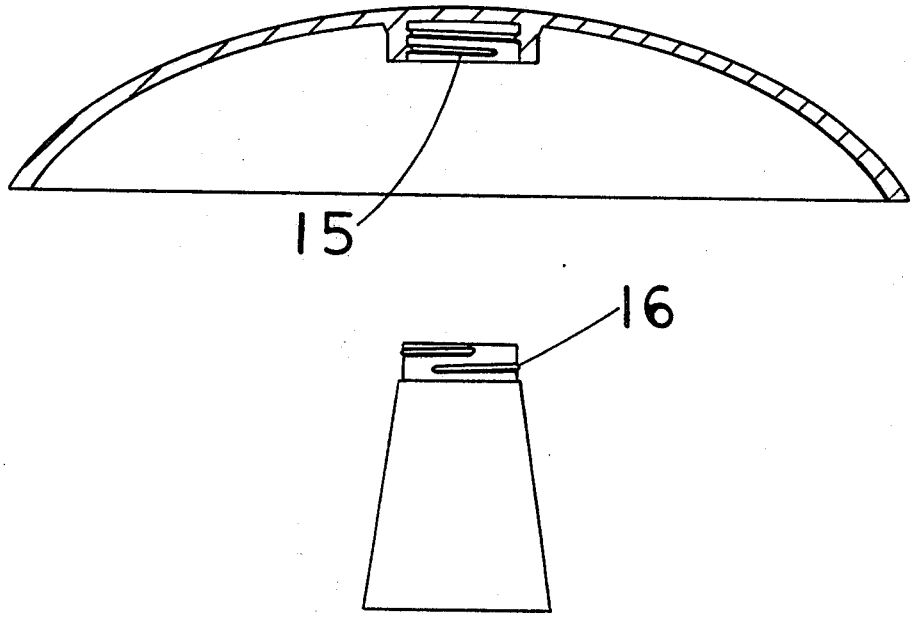
FIG. 5 is an elevated view showing the head in vertical section and the stem in elevation and illustrating a variation in the means of assembling the two parts of the invention without fastening them permanently.
Figure 6:
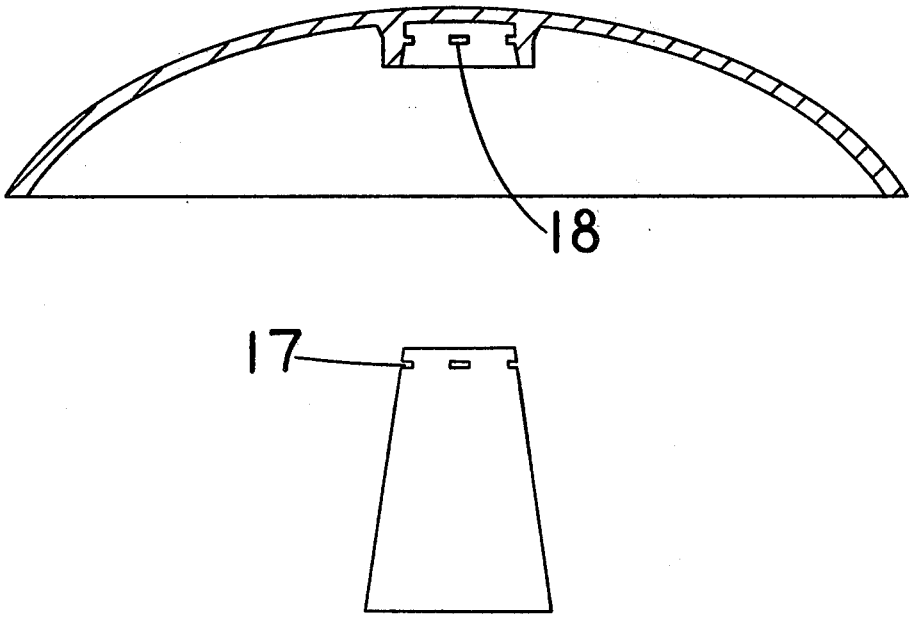
FIG. 6 is an elevated view showing the head in vertical section and the stem in elevation and illustrating a second variation in the means of assembling the two parts of the invention without fastening them permanently.

In a variation of the invention the threaded bolt structure would be fastened to or incorporated into the head and stem, and the threaded structure, provided as a means of attaching the two parts, would then not comprise a separate or third part, and the recess provided in the top center of the head would not be required. This variation in the means of assembling the two parts of the invention without fastening them permanently is illustrated in FIG. 5, showing the female screw thread incorporated into the bottom center of the head at 15 and the male screw thread incorporated into the upper portion of the stem at 16. In another variation of the invention the head and stem would be provided with a snap fitting structure as a means of attaching the two parts and then no threaded structure or openings for a threaded structure would be required. This second variation in the means of connecting the two parts of the invention without fastening them permanently is illustrated in FIG. 6, showing horizontal slots provided to the upper portion of the stem at 17 and flexible horizontal tabs arranged in the bottom center of the head at 18. In this second variation, the flexible tabs at 18 snap into the slots at 17 when the head and the stem are pressed and fitted together, effecting a sufficient connection of the two parts. The reverse procedure of pulling the head and the stem apart causes the flexible tabs at 18 to snap out of the slots at 17, effecting disassembly of the two parts. A variety of known means of attaching the two parts without fastening them permanently have been considered by the inventor. The invention is embodied in the combination of the two parts but not in the means of attachment. A means of attaching the two parts which is known, and which does not fasten the two parts permanently, and which does not defeat the space-saving advantage of the invention, is a variation of the invention. The invention is not restricted to the threaded bolt structure as the means of attaching the two parts.

The description and drawings presented here do not describe or illustrate every possible variation of the invention, and it is the intention of the inventor to encompass all possible variations of the invention in the following claims.

I claim:

1. A combination of two parts, the first part being a convex mushroom-cap-shaped head, provided with a recess in the top center and an opening through the center for receiving a threaded bolt, and the second part being a slightly tapered tumbler-shaped hollow stem, provided with an opening through the center for receiving a threaded bolt; and the two parts when attached by compression of a threaded bolt yielding a mushroom-form support which is fitted onto a pole and used to support film or fabric to make a temporary shelter for plants; and, each of the two said parts fitting partly inside the volume of another of the same part when said parts are disassembled and stacked in sets for packaging or shelving or shipping or storage.

2. A combination of two parts, the first part being a convex mushroom-cap-shaped head, and the second part being a slightly tapered tumbler-shaped hollow stem, the two parts when assembled yielding a mushroom form support which is fitted onto a pole and used to support film or fabric to make a temporary shelter for plants, wherein the improvement comprises both of the two said parts fitting partly inside the volume of another of the same part when said parts are disassembled and stacked in sets for packaging or shelving or shipping or storage; and, the means provided for assembling the two parts securely without fastening them permanently being a female screw thread incorporated into the bottom center of the convex head structure and a male screw thread incorporated into the upper portion of the stem structure; the improved portion of the mushroom form support being the structural restriction in both parts of the combination, the convex head and the tapered stem, of fitting partly inside the volume of another of the same part when disassembled and stacked.

3. A combination of two parts, the first part being a convex mushroom-cap-shaped head, and the second part being a slightly tapered tumbler-shaped hollow stem, the two parts when assembled yielding a mushroom form support which is fitted onto a pole and used to support film or fabric to make a temporary shelter for plants, wherein the improvement comprises both of the two said parts fitting partly inside the volume of another of the same part when said parts are disassembled and stacked in sets for packaging or shelving or shipping or storage; and, the means provided for assembling the two said parts securely without fastening them permanently being flexible horizontal tabs arranged in the bottom center of the head structure and horizontal slots provided to the upper portion of the stem structure, said tabs snapping into position inside said slots when the two parts are fitted together; the improved portion of the mushroom form support being the structural restriction in both parts of the combination, the convex head and the tapered stem, of fitting partly inside the volume of another of the same part when disassembled and stacked.

* * * * *